US009179719B1

(12) United States Patent
Goldberg

(10) Patent No.: US 9,179,719 B1
(45) Date of Patent: Nov. 10, 2015

(54) GARMENT WITH BLADDER

(71) Applicant: Steve Goldberg, Malibu, CA (US)

(72) Inventor: Steve Goldberg, Malibu, CA (US)

( * ) Notice: Subject to any disclaimer, the term of this patent is extended or adjusted under 35 U.S.C. 154(b) by 205 days.

(21) Appl. No.: 13/903,149

(22) Filed: May 28, 2013

Related U.S. Application Data

(60) Provisional application No. 61/655,335, filed on Jun. 4, 2012.

(51) Int. Cl.
*A41D 27/00* (2006.01)
*A41D 13/00* (2006.01)

(52) U.S. Cl.
CPC ..... *A41D 27/00* (2013.01); *A41D 13/0015* (2013.01)

(58) Field of Classification Search
CPC ..... A41D 13/0015; A41D 1/02; A41D 1/04; A41D 27/00; A41B 1/02; A41B 1/00
See application file for complete search history.

(56) References Cited

U.S. PATENT DOCUMENTS

| | | | | |
|---|---|---|---|---|
| 5,864,880 | A * | 2/1999 | Adam | 2/94 |
| 5,993,972 | A * | 11/1999 | Reich et al. | 428/423.1 |
| 6,220,490 | B1 * | 4/2001 | O'Hara | 224/148.2 |
| 2002/0124294 | A1 * | 9/2002 | McKenzie et al. | 2/69 |
| 2004/0128747 | A1 * | 7/2004 | Bumbarger et al. | 2/458 |
| 2006/0113336 | A1 * | 6/2006 | Spencer | 224/148.2 |
| 2010/0101253 | A1 * | 4/2010 | Searle | 62/259.3 |
| 2010/0308086 | A1 * | 12/2010 | Chapuis | 224/148.2 |
| 2011/0131713 | A1 * | 6/2011 | DaRosa et al. | 2/463 |
| 2014/0013481 | A1 * | 1/2014 | Lee | 2/69 |
| 2014/0013482 | A1 * | 1/2014 | DiBernardo et al. | 2/102 |

* cited by examiner

*Primary Examiner* — Shaun R Hurley
*Assistant Examiner* — Andrew W Sutton

(57) ABSTRACT

An exercise garment for use in outdoor sports wherein protection from the sun is desired along with a means of hydration. The garment provides protection from the sun through its barrier properties and can provide additional protection through the use of sun reflective and sun screening materials incorporated therein. The garment includes a bladder for the containment therein of water or other potable fluid and the bladder includes a conduit that reaches from the reservoir of fluid to the mouth of the wearer.

6 Claims, 2 Drawing Sheets

GARMENT WITH BLADDER

REFERENCE TO PRIOR APPLICATION

This application claims priority of the provisional patent application 61/655,335, filed Jun. 4, 2012 entitled SHIRT TO BE WORN EITHER IN OR OUT OF THE WATER THAT HAS A SEWN IN POCKET ON THE BACK THAT IS USED TO HOLD A WATER HYDRATE BAG. THE POCKET IS PART OF A STRUCTURE OF PANELS THAT CONNECT TO EACH OTHER. THESE PANELS ALONG WITH THE FORM FITTING BODY OF THE SHIRT, KEEPS THE POCKET IN PLACE WITH THE HYDRATE BAG FILLED WITH WATER by Steve Goldberg.

BACKGROUND OF THE INVENTION

1. Field of the Invention

The field of this invention relates generally to the field of the exercise clothing and more particularly toward a garment to be used in outdoor sports where protection from the sun is sought that also provides a hydration means.

2. Description of the Prior Art

Water sports are a very popular recreational activity worldwide. Typical water sports include water skiing, swimming, surfing, windsurfing, jetskiing and many other activities. One consideration when participating in these activities is keeping warm and another is keeping free of unhealthy ultraviolet rays from the sun. An additional consideration is the need to keep hydrated due respiration and exertion during participation.

One way to keep warm is the use of a wetsuit to keep body heat in. One shortcoming of wetsuits is a rash that is commonly caused by the seams in the neoprene typically used against the skin of the wearer. To overcome this problem, rash guards came into use for the user to wear underneath the wetsuit to protect the skin.

Over time, rash guards began to be used even when there was no wetsuit in order to protect the exposed skin from the sun and have been manufactured with SPF materials. In recent years, a new water sport has taken the water sports industry by storm and that is stand up paddling (SUP). SUP involves standing on a board like a surfboard and paddling with a paddle in a standing position to propel the rider forward. During this activity, it is not uncommon to wear a rash guard to protect from the sun.

Like other outdoor sports, such as cycling and hiking, there is a combined need for sun protection as well as an easy means of hydration. In the past, hydration was provided for non-water outdoor sports through water bottles or bladders filled with water that could be attached to clothing or a backpack. The instant invention seeks to provide an improved hydration/sun protection product that is a single garment that provides sun protection and a pocket for the placement therein of a hydration bladder.

SUMMARY OF THE INVENTION

The basic embodiment of the present invention teaches a new rash guard that includes a pocket for the placement therein of a bladder so that the user can hydrate during the activity without having to include equipment other than the rash guard, such as a backpack or strap-on bladder. The rash guard operates like a typical rash guard in that it can protect the skin from the sun through coverage and/or SPF materials. Additionally, however, a bladder is included in the shirt and secured in a pocket therein. A conduit connects the bladder, filled with water or other hydrating fluid to a position easily accessible by the mouth of the user.

The garment is for wearing during outside activities comprising: a front panel; a rear panel; an open neck; an opening for each arms of a user; an open bottom wherein said front panel, rear panel, open neck and openings for the arms are all connected to create a shirt with or without sleeves; a first supporting panel extending substantially horizontally from said front panel to said rear panel near said open bottom; a second supporting panel extending substantially vertically from said front panel to said rear panel near said open neck; a pocket having a base attached to said garment at said first supporting panel and said second supporting panel said pocket having an internal space therein for the placement of a bladder, said bladder to be fillable with liquid; a conduit extending from said bladder along said second supporting panel in a vertical direction over the shoulder of the wearer to said front panel, said conduit terminating in a mouthpiece for the retrieval of said fluid in said bladder as desired.

The above embodiment can be further modified by defining that said garment is made of a material that offers protection from the sun.

The above embodiment can be further modified by defining that said conduit is secured to said front panel and said rear panel through securing members.

A second embodiment teaches a method of hydrating during outdoor sports comprising the steps of: obtaining a garment comprising: a front panel; a rear panel; an open neck; an opening for each arms of a user; an open bottom wherein said front panel, rear panel, open neck and openings for the arms are all connected to create a shirt with or without sleeves; a first supporting panel extending substantially horizontally from said front panel to said rear panel near said open bottom; a second supporting panel extending substantially vertically from said front panel to said rear panel near said open neck; a pocket having a base attached to said garment at said first supporting panel and said second supporting panel said pocket having an internal space therein for the placement of a bladder, said bladder to be fillable with liquid; a conduit extending from said bladder along said second supporting panel in a vertical direction over the shoulder of the wearer to said front panel, said conduit terminating in a mouthpiece for the retrieval of said fluid in said bladder as desired; filling said bladder with water or other hydrating liquid; securing said bladder into said pocket; putting said garment over the torso of said user; and engaging in said outdoor activity, drinking fluid from said bladder as needed.

The above embodiment can be further modified by defining that said garment is made of a material that offers protection from the sun.

The above embodiment can be further modified by defining that said conduit is secured to said front panel and said rear panel through securing members.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
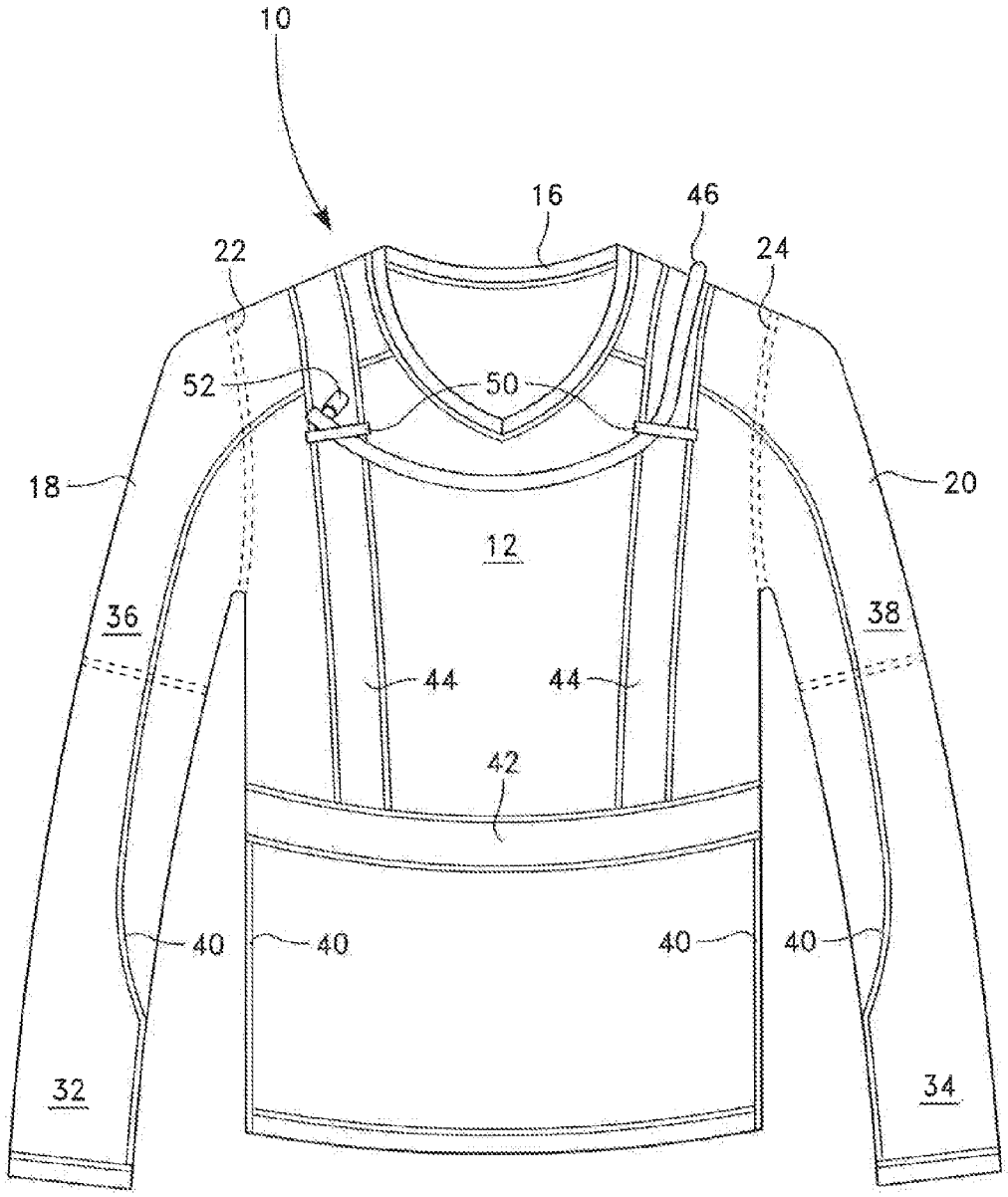
FIG. 1 is a front view of the garment of the instant invention.
Figure 2:
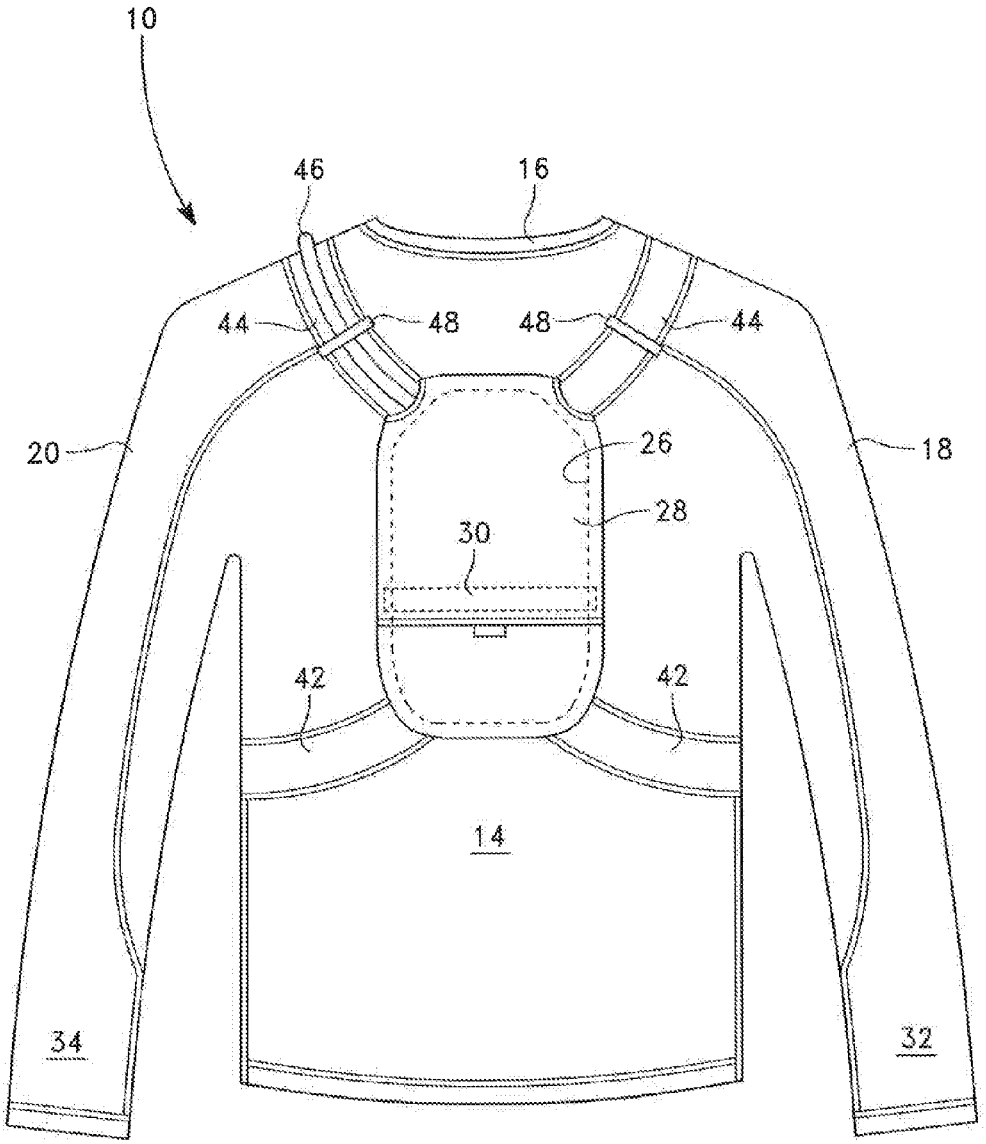
FIG. 2 is a back view of the garment of the instant invention.

Turning to the drawings, the preferred embodiment is illustrated and described by reference characters that denote similar elements throughout the several views of the instant invention.

The preferred embodiment is a exercise garment 10 that is worn like a standard shirt having a front panel 12, back panel 14, an open neck 16 and two sleeves 18, 20. The sleeves 18, 20 can be long 32, 34, short 36, 38 or non-existent, just providing openings 22, 24 for the arms of the user to fit therethrough. The fabric of which the garment 10 is made can be any fabric as desired and can include the use of SPF materials. Like most rash guards, the stitching on the garment 10 is mostly a flat lock type stitch so that there is no rash while rubbing up against the skin at the seams 40.

On the back panel 14 is a pocket 26 into which a bladder 28 can be placed. Inside the bladder 28 is water or other hydrating fluid for use by the user during the exercise activity. The bladder 28 is secured in the pocket 26 by a fastening means, such as a hook and loop system 30 or other suitable fastening means. The pocket 26 can be made from a variety of materials. The pocket 26 has a base that connects to structural panels 42, 44 on the garment 10. The structural panels 42, 44 connect to the base of the pocket 26 on the back panel 14 of the garment 10. The base of the pocket 26 is sewn onto the back panel 14 of the garment 10.

The structural panels 42, 44 are contained on both the front panel 12 and the rear panel 14 of the garment 10. The bottom structural panel 42 is oriented horizontally and extends around both the front panel 12 and the rear panel. The top structural panel 44 is oriented vertically and extends from the pocket 26 up the torso and over the shoulders to the front panel 12 of the garment 10. Extending from the bladder 28 is a conduit 46 that is secured the vertical structural panel 44 through a securing piece 48. The conduit 46 extends over the shoulder to the front panel 12 of the garment and is secured in place through another securing piece 50. The conduit 46 terminates in a mouth piece 52 through which the user can consume the water or other hydrating fluid and the mouth piece 52 rests in a position proximate enough the mouth of the user to provide easy access with or without the use of the hands.

To use, the wearer fills the bladder 28 with water or other hydrating fluid and secures the bladder 28 in the pocket 26. The wearer then puts the garment 10 and proceeds to engage in the activity all the while having easy access to the water or other hydrating fluid which can be consumed as needed.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A one-piece, self-contained garment for wearing during outside activities comprising:

a front panel;

a rear panel;

an open neck;

an opening for each arms of a user;

an open bottom wherein said front panel, rear panel, open neck and openings for the arms are all connected to create a shirt with or without sleeves;

a first structural panel permanently sewn into said front panel and said rear panel extending substantially horizontally from said front panel to said rear panel near said open bottom;

a second structural panel permanently sewn into said front panel and said rear panel extending substantially vertically from said front panel to said rear panel near said open neck thereby producing a self-contained one-piece garment that requires no pre-assembly;

a pocket permanently sewn into said rear panel having a base attached to said garment at said first structural panel and to said second structural panel said pocket having an internal space therein for the placement of a bladder, said bladder to be fillable with liquid;

a conduit extending from said bladder along said second structural panel in a vertical direction over the shoulder of the wearer to said front panel, said conduit terminating in a mouthpiece for the retrieval of said fluid in said bladder as desired.

2. The garment as defined in claim 1 wherein said garment is made of a material that offers protection from the sun.

3. The garment as defined in claim 1 wherein said conduit is secured to said front panel and said rear panel through securing members.

4. A method of hydrating during outdoor sports comprising the steps of:

obtaining a one-piece, self-contained garment comprising:

a front panel;

a rear panel;

an open neck;

an opening for each arms of a user;

an open bottom wherein said front panel, rear panel, open neck and openings for the arms are all connected to create a shirt with or without sleeves;

a first structural panel permanently sewn into said front panel and said rear panel extending substantially horizontally from said front panel to said rear panel near said open bottom;

a second structural panel permanently sewn into said front panel and rear panel extending substantially vertically from said front panel to said rear panel near said open neck thereby producing a self-contained, one-piece garment that requires no pre-assembly;

a pocket permanently sewn into said rear panel having a base attached to said garment at said first structural panel and to said second structural panel said pocket having an internal space therein for the placement of a bladder, said bladder to be fillable with liquid;

a conduit extending from said bladder along said second structural panel in a vertical direction over the shoulder of the wearer to said front panel, said conduit terminating in a mouthpiece for the retrieval of said fluid in said bladder as desired;

filling said bladder with water or other hydrating liquid;

securing said bladder into said pocket;

putting said garment over the torso of said user; and engaging in said outdoor activity, drinking fluid from said bladder as needed.

5. The method as defined in claim 4 wherein said garment is made of a material that offers protection from the sun.

6. The method as defined in claim 4 wherein said conduit is secured to said front panel and said rear panel through securing members.

* * * * *